US010207140B2

(12) United States Patent
Carriere, Jr.

(10) Patent No.: US 10,207,140 B2
(45) Date of Patent: Feb. 19, 2019

(54) KINETIC RESISTANCE APPARATUS

(71) Applicant: Robert Omer Carriere, Jr., Oakville (CA)

(72) Inventor: Robert Omer Carriere, Jr., Oakville (CA)

(73) Assignee: Robert Omer Carriere, Jr., Ontario (CA)

( * ) Notice: Subject to any disclaimer, the term of this patent is extended or adjusted under 35 U.S.C. 154(b) by 143 days.

(21) Appl. No.: 15/085,749

(22) Filed: Mar. 30, 2016

(65) Prior Publication Data

US 2016/0206912 A1 Jul. 21, 2016

Related U.S. Application Data

(60) Provisional application No. 62/144,526, filed on Apr. 8, 2015.

(51) Int. Cl.
*A63B 21/045* (2006.01)
*A63B 21/00* (2006.01)
(Continued)

(52) U.S. Cl.
CPC ..... *A63B 21/151* (2013.01); *A63B 21/023* (2013.01); *A63B 21/0428* (2013.01); *A63B 21/0552* (2013.01); *A63B 21/154* (2013.01); *A63B 21/4005* (2015.10); *A63B 21/4009* (2015.10); *A63B 21/4025* (2015.10); *A63B 21/4043* (2015.10); *A63B 23/0355* (2013.01); *A63B 23/03533* (2013.01); *A63B 23/1209* (2013.01); *A61H 1/0237* (2013.01); *A63B 21/00069* (2013.01); *A63B 21/00178* (2013.01); *A63B 21/00185* (2013.01); *A63B 21/1609* (2015.10); *A63B 21/4035* (2015.10); *A63B 23/0494* (2013.01); *A63B 26/003* (2013.01);
(Continued)

(58) Field of Classification Search
CPC ..... A63B 21/4025; A63B 21/1609; A63B 21/0442; A63B 21/151; A63B 21/156; A63B 2208/0233; Y10S 482/904; A47C 9/002
See application file for complete search history.

(56) References Cited

U.S. PATENT DOCUMENTS 4,961,573 A * 10/1990 Wehrell ..... A63B 21/0552 482/124
5,792,034 A * 8/1998 Kozlovsky ..... A63B 21/0004 482/124
(Continued)

*Primary Examiner* — Joshua T Kennedy
(74) *Attorney, Agent, or Firm* — Norton Rose Fulbright Canada LLP

(57) ABSTRACT

A portable and kinetic motion resistance upper body invention that can be used for a variety of exercises. This invention combines dial tension adjustment clutch sheaves, a variable linear tract bearing and a one piece resistance shock-cord, together these core components achieve a unique minimal impact work-out. The multi-motion and changeable adjustments for this invention, result in a wide variety of muscular stimulation and therapeutic exercises that are non-existent in the fitness and health industry. The outcome of the mechanism can be customized for a particular sport requirement or physio and other therapeutic restorations, or even for case specific industrial and robotic counter-balancing controls.

16 Claims, 6 Drawing Sheets

(51) Int. Cl.

| | |
|---|---|
| ***A63B 21/055*** | (2006.01) |
| ***A63B 21/02*** | (2006.01) |
| ***A63B 23/035*** | (2006.01) |
| ***A63B 23/12*** | (2006.01) |
| ***A63B 21/04*** | (2006.01) |
| *A63B 23/04* | (2006.01) |
| *A63B 26/00* | (2006.01) |
| *A63B 71/00* | (2006.01) |
| *A63B 21/16* | (2006.01) |
| *A61H 1/02* | (2006.01) |

(52) U.S. Cl.
CPC ..... *A63B 2071/0018* (2013.01); *A63B 2208/0204* (2013.01); *A63B 2208/0233* (2013.01)

(56) References Cited

U.S. PATENT DOCUMENTS 5,813,953 A * 9/1998 Whipple ..... A63B 21/169 482/123
6,159,133 A * 12/2000 Shugg ..... A63B 21/023 482/121
7,563,212 B2 * 7/2009 Smith ..... A63B 21/025 482/124
7,775,936 B2 * 8/2010 Wilkinson ..... A63B 22/0005 482/51
8,162,809 B1 * 4/2012 Eastwood ..... A63B 21/0552 482/123
8,727,952 B1 * 5/2014 Carle ..... A63B 21/4043 482/102
9,409,501 B2 * 8/2016 Henry ..... A63B 21/00069
9,649,522 B2 * 5/2017 Wyatt ..... A63B 21/0442
9,795,818 B2 * 10/2017 Powell ..... A63B 21/015
2006/0217245 A1 * 9/2006 Golesh ..... A63B 21/063 482/94
2010/0041526 A1 * 2/2010 Bowser ..... A63B 21/04 482/123
2011/0183819 A1 * 7/2011 Pharoe ..... A63B 21/0552 482/105
2012/0058864 A1 * 3/2012 Mizrachy ..... A63B 21/0552 482/124

* cited by examiner

KINETIC RESISTANCE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING COMPACT DISC APPENDIX

Not Applicable

BACKGROUND OF THE INVENTION

The inventor recognized a need for an upper body exercise apparatus that is lightweight, portable, versatile, low impact, multi-muscle targeting, and totally adjustable. The unit ideally should be able to vary in tension to accommodate the exercise needs of physiotherapy patients with decreased mobility, to the strongest and most mobile athletes. This invention has created a solution that supports portability, while providing kinetic alignment. The user of this invention can simultaneously exercise the lower and upper body, while performing natural movements, such as, but not limiting to walking, jogging, running, and skating.

BRIEF SUMMARY OF THE INVENTION

The Kinetic Resistance Apparatus is an exercise device that allows the user to apply additional mass output with individual or dually extended arm movements. The device solves for natural kinetic outputs, using mechanically aligned configurations. In the worn on back position, the user can mimic natural bodily movements, allowing for a greater mass output and shorter training intervals. This device uses a fluid form of singular impact transfer, allowing for anti-climactic retraction. This retraction targets the opposite arms negative muscle tissues, to correct form and balance while performing various upper body movements.

Figure 1:
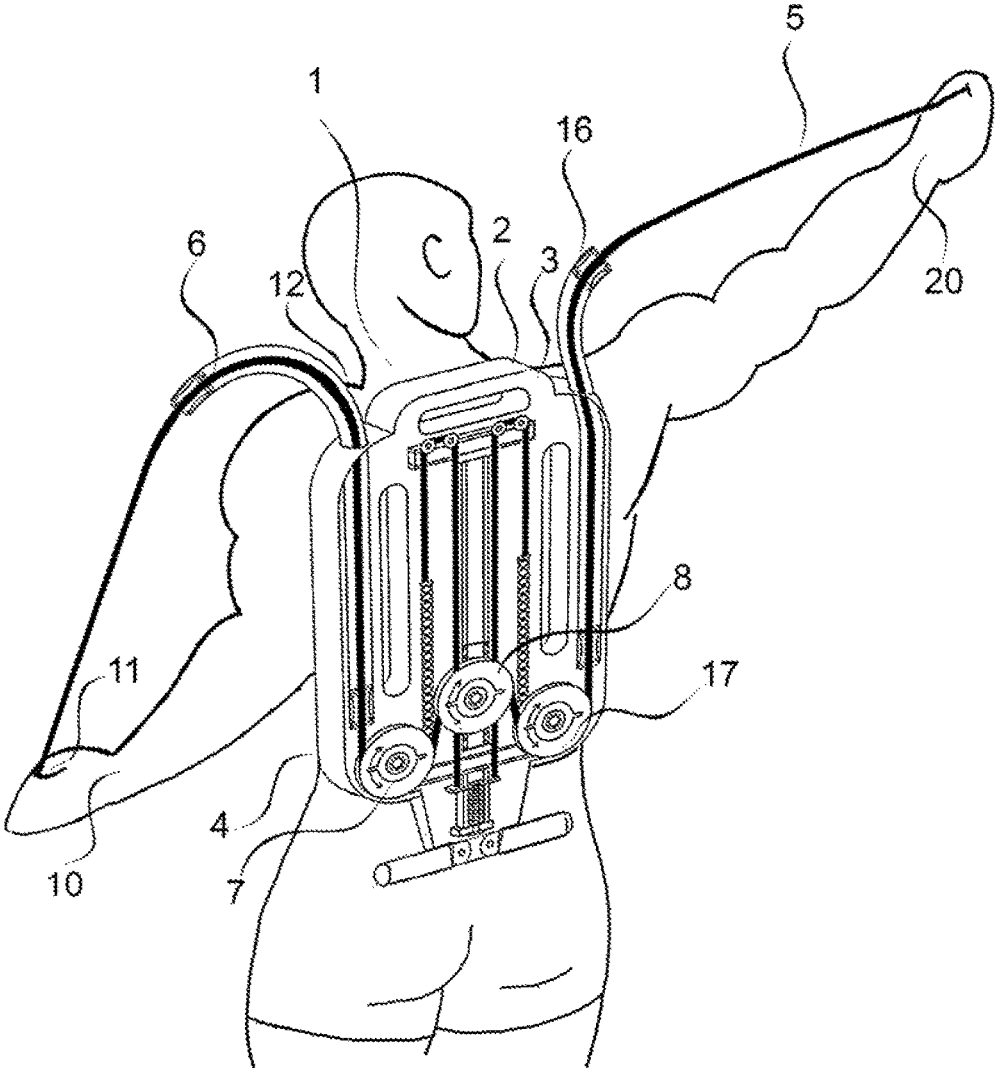
FIG. 1.
Figure 2:
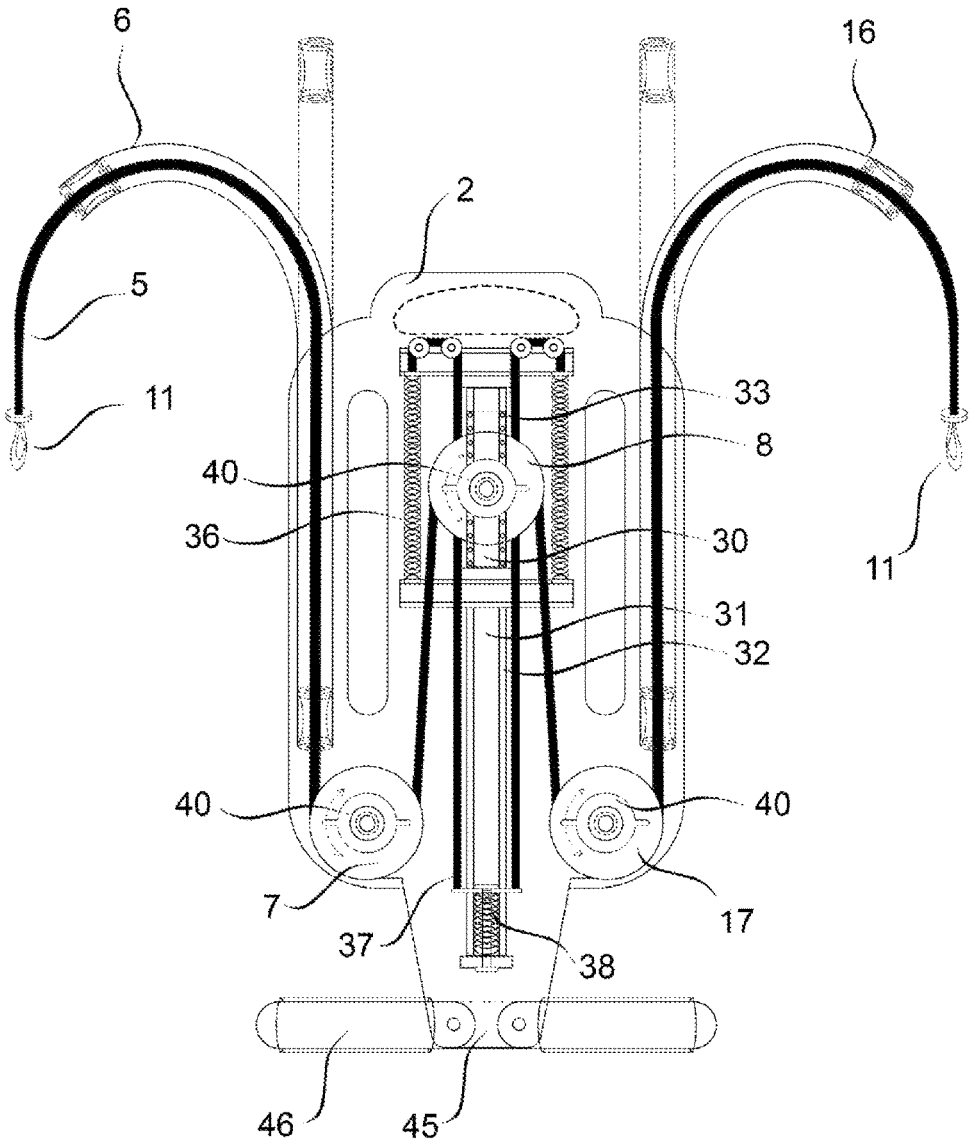
Figure 3:
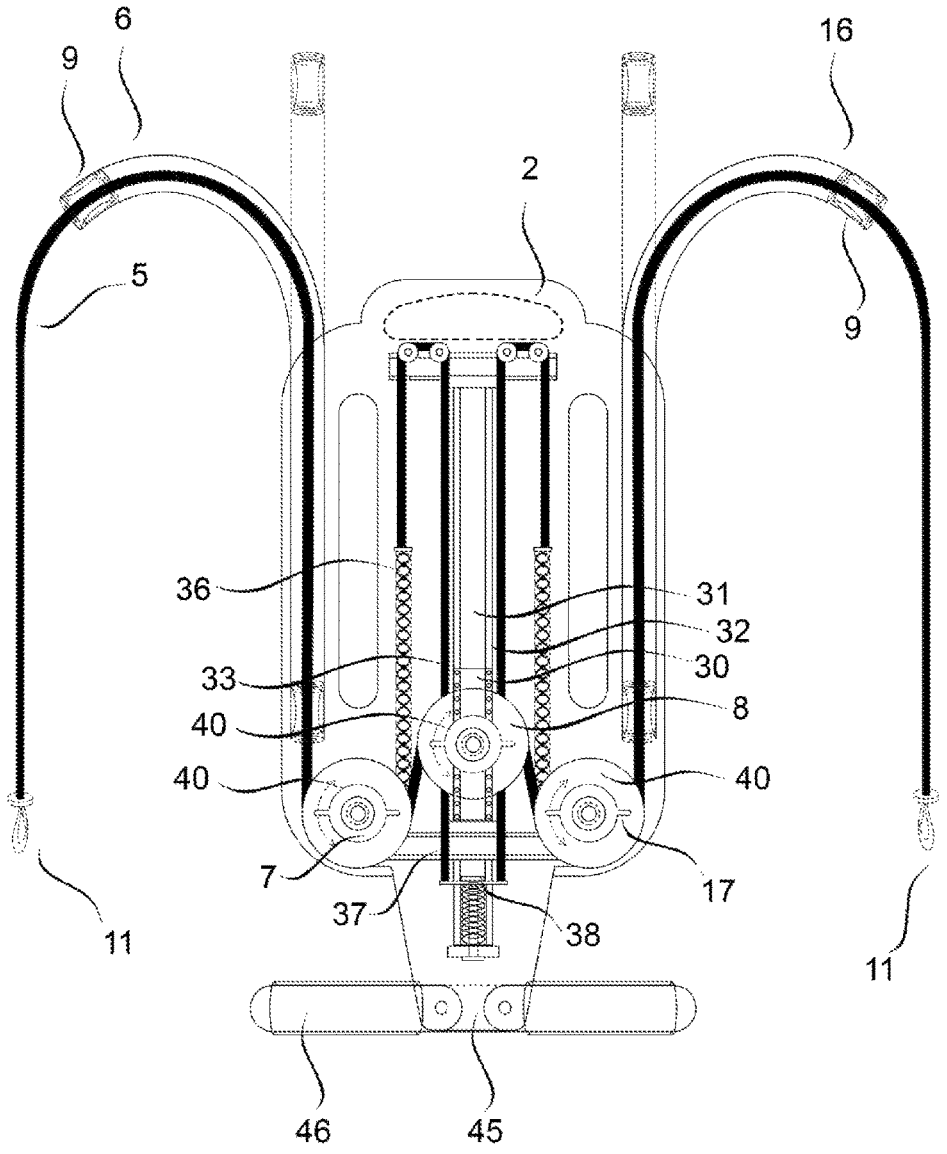
Figure 4:
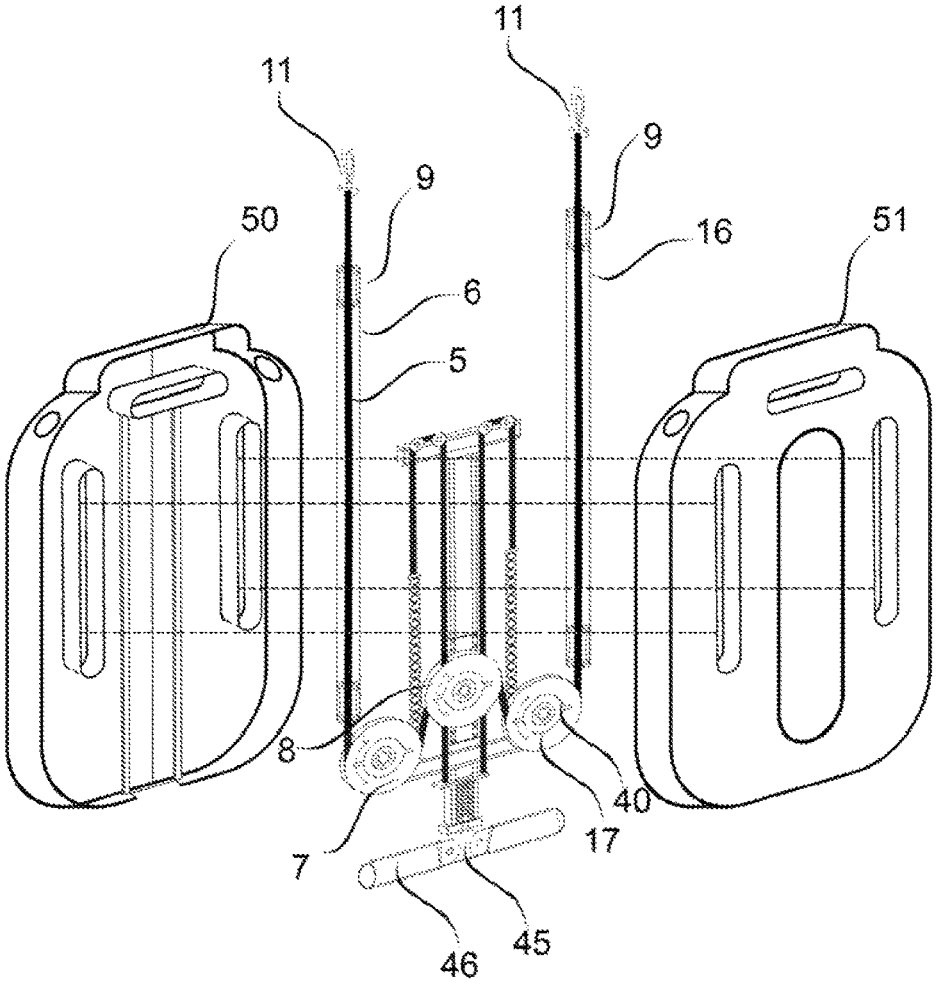
Figure 5:
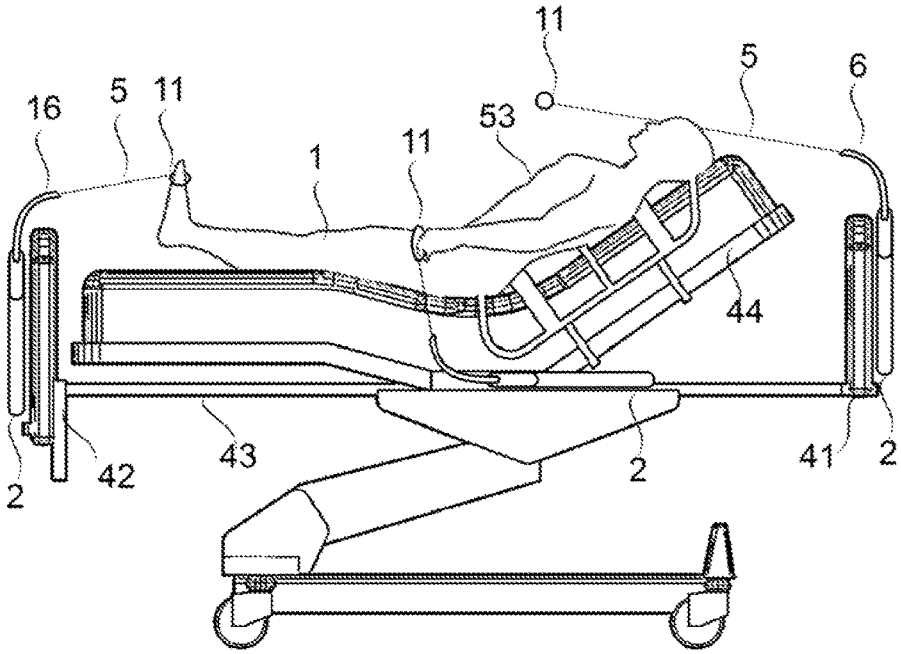
Figure 6:
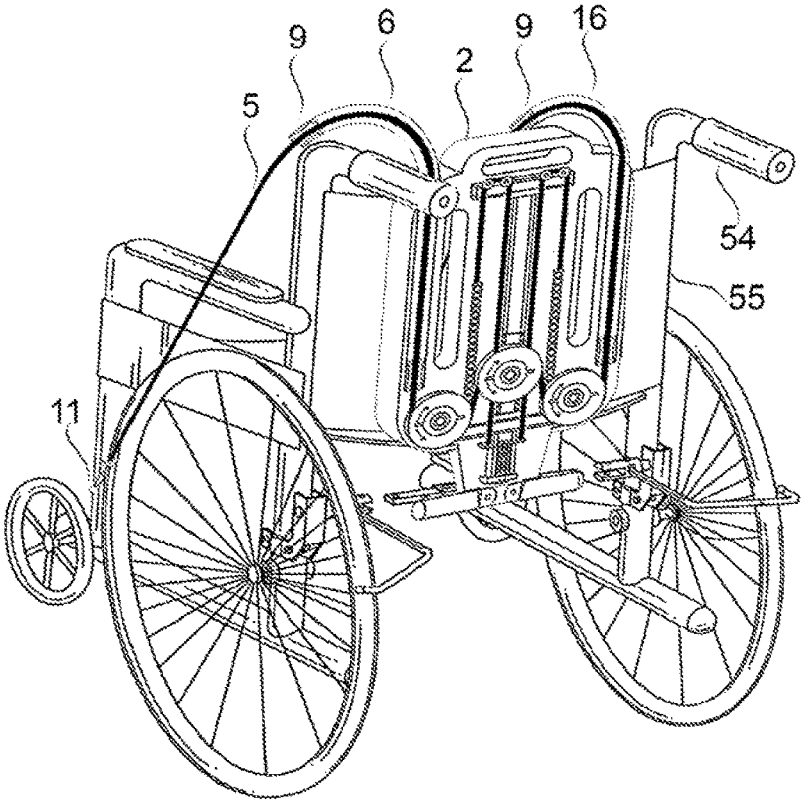

Is a rear view of a person wearing the kinetic resistance apparatus on his back, extending his right arm forward and his left arm downward.

FIG. 2.

Is a view of the inner workings of the kinetic resistance apparatus, in the non-extended position. This position places the operating sheave at the minimal tension position.

FIG. 3.

Is a view of the inner workings of the kinetic resistance apparatus, in the extended position. This position places the operating sheave at the maximum tension position.

FIG. 4.

Is a sectional breakdown of the kinetic resistance apparatus, and its operating features.

FIG. 5.

Is a view of an optional application, by which the kinetic resistance apparatus is attached to a hospital bed in multiple configurations and/or positions. These positions function to perform therapeutic requirements of various muscle groups.

FIG. 6.

Is an isometric view of the kinetic resistance apparatus attached to a wheelchair or other applicable device.

DETAILED DESCRIPTION OF THE INVENTION

FIG. 1.

A fitness apparatus (2), mounted to the back of an individual (1). It is anchored to the individual (1) via shoulder straps (3), waist straps (4) and/or a wearable fabric vestment. This apparatus is primarily for upper body physiotherapy and exercise.

The operation of the apparatus (2); begins with the left hand and arm (10) of the individual (1) in a downward stretching exercise. A ring or handle (11) works as a holding device for an elastic or stretchable cord (5). The elastic or stretchable cord (5) is protruding from and guided by a flexible metal tube (6) that is curving over the shoulder (12). The left flexible metal tube (6) guides the stretchable cord (5) into the fitness apparatus (2) and into the left re-directional sheaves (7). There are two re-directional sheaves, one for the left side (7) and one for the right side (17). The stretchable cord (5) circles around the re-directional sheaves (7) and forwards the stretchable cord (5) to the central sheave (8). The central sheave (8) forwards the stretchable cord (5) to the opposing/right re-directional sheave (17). The stretchable cord (5) circles around the right re-directional sheave (17) and into the opposing/right flexible metal tube (16). This flexible metal tube (16) guides the stretchable cord (5) within it and over the right shoulder (15). The stretchable cord (5) exits the right flexible metal tube (16) and forwards towards the right hand (20). This individual (1) is shown with the right hand and arm (20) being stretched and exercised in an outward fashion. The exercise and movements can be in all angles of forward, upward, downward and outward directions.

FIG. 2.

This is a detailed image of the inner workings of the apparatus (2). This drawing demonstrates the path of the stretchable cord (5) and its path inside the flexible metal tubes (6) and (16). The path of the stretchable cord (5) is also shown circling around the left (7) and right (17) re-directional sheaves. It also shows the one piece stretchable cord (5) going around the center sheave (8). This design of a one piece/one length of stretchable cord (5) results in a uniform tension across the complete stroke.

To further enhance the uniformity of tension in the stroke, the center sheave (8) is anchored within and on a linear track bearing (30). This linear track bearing comprises of, but not limited to a sliding rail (31) and an anchored rail (32) with roller bearing (33). The roller bearing (33) provides a quiet and smooth travel up and down the anchored rail (32). The travel of the linear bearing (30) movement is further tensioned by restricting the travel using coiled tension springs (36). These coiled tension spring (36) expand and contract with the motion of the linear track bearing (30). The linear track bearing (30) tension is further made adjustable by attaching the coiled tension springs (36) via a cable (37) to a tension adjustment (38). This unique feature varies the tension through different parts of the stroke.

This diagram also displays the dial clutch adjustable tensioner (40) located on both the left (7) and right (17) re-directional sheaves as well as on the central sheave (8). Adjusting these dial clutch adjustable tensioners on the left (7) and right (17) re-directional sheaves results in an increase or decrease tension for either the left arm (10) or right arm (20) as required. The dial clutch adjustable tensioner (40) on the center sheaves (8) adjust the overall tension for the complete stroke.

FIG. 3.

This drawing shows the tensioners (36) for the linear bearing (30) in different stages of adjustment. The coiled tension springs (36) are in the expansion state and the positioning of the coiled tension spring (36) anchor has been lowered by adjusting the tension adjustment (38). This results in changing the higher tension of the stroke from the beginning of the stroke to the end of stroke.

This drawing also visually shows the stretchable cord (5) extended outward and at the end of the stroke beyond the flexible metal tube (7) and (17) ends. Both ends of the flexible metal tube (7) and (17) are shown to have tapered insert (9). These tapered inserts (9) allow the stretchable cord (5) to travel smoothly in and out of the flexible metal tubing (6) without damage, or friction.

At the base (45) of the apparatus (2) is a contoured padded support (46). This padded support (46) rests firmly and comfortably on the lower back and above the buttocks of the individual (1). This padded support (46) also doubles as a foot anchor for a multitude of additional exercises.

FIG. 4.

This is an isometric view of the apparatus (2) and displays how the apparatus (2) is constructed of a formed backing case (50) and a formed frontal case (51). The formed backing case (50) and the formed frontal case (51) are interlocked together to create a sealed enclosure (52). Within the lightweight sealed enclosure (52) are the re-directional sheaves (7) and (17), the flexible metal tubes (6) and (16), the center sheave (8) as well as all the working components in the adjustable linear track bearing assembly (30).

FIG. 5.

This is a two dimensional drawing applying the apparatus (2) in the fixed position at the headboard (41), footboard (42), and base (43) of a hospital bed (44). In these positions the apparatus (2) can take advantage of the adjustable tensioners (40), to achieve the ideal physio requirements for a bed (44) ridden patient (53). The apparatus (2) in these positions headboard (41), footboard (42) and base (43), are strategically positioned to maximize the most common physiotherapy needs of the patient (53). It is considered by this inventor that the apparatus (2) can be fixed but not limited to these positions or this particular type of structure. Ex. It can also be fixed to a wall.

FIG. 6.

This is a three-dimensional view of the apparatus (2) attached to a mobile device, in this example a wheelchair (54). The apparatus (2) is anchored to the back of this mobile device, however, it can be attached to the seat (55) or other location to achieve the physiotherapy needs of the patient. The apparatus (2) may also work as an assistance for an automated exercise for incapacitated legs to prevent muscle atrophy. It is considered by this inventor that the apparatus (2) can be fixed to multiple mobile devices. Examples, but not limiting to. Airplane seats, vehicle passenger seats.

I claim:

1. An apparatus configured to be mounted to the back of an individual or to a fixed structure, comprising:

a series of dial tensioned adjustable sheaves;

a single length of stretchable shock cord which tracks around the series of dial tensioned adjustable sheaves to provide an adjustable tension on the cord, the cord having free ends on each side of the apparatus, each free end having a ring or handle;

the series of dial tensioned adjustable sheaves having fixed left and right re-directional sheaves, each of the left and right re-directional sheaves having a dial tensioner to individually increase or decrease tension of the cord.

2. The apparatus of claim 1 further comprising an adjustable linear track bearing, wherein the series of dial tensioned adjustable sheaves comprises a movable central sheave anchored to and movable along the linear track bearing, the linear tracking bearing providing tension on the cord as the central sheave moves along the linear bearing.

3. The apparatus of claim 1 wherein the series of dial tensioned adjustable sheaves comprise a movable central sheave and a linear track bearing, wherein the movable central sheave is anchored to and movable along the linear track bearing to adjust tension on the cord.

4. The apparatus of claim 3 wherein the movable central sheave has a dial tensioner to adjust overall tension of the cord.

5. The apparatus of claim 3 wherein the linear track bearing comprises coiled tension springs that expand or contract with motion of the linear track bearing, wherein the linear track bearing provides the tension via the springs as the movable central sheave moves along the linear bearing as a result of pulling of the cord.

6. The apparatus of claim 1 further comprising a pack configured to be mounted via straps and/or a wearable fabric vestment, the pack holding the series of dial tensioned adjustable sheaves and the free ends of the cord extending out of the sides of the pack.

7. The apparatus of claim 1 further comprising flexible tubes on either side of the apparatus for guiding the cord into the fixed left and right re-directional sheaves, the free ends of the cord protruding from the flexible tubes.

8. A fitness apparatus configured to be mounted to the back of an individual or to a fixed structure, comprising:

a pack configured to be mounted via straps and/or a wearable fabric vestment, comprising fixed left and right re-directional sheaves; a movable central sheave; a linear track bearing comprising a sliding rail, an anchored rail with a roller bearing, and coiled tension springs;

wherein the central sheave is anchored to and movable along the linear track bearing;

an elastic or stretchable cord having free ends on each side of the pack, each of the free ends having a ring or handle;

the cord extending into the pack and circling around the re-directional and central sheaves such that the linear bearing provides a tension via the springs as the central sheave moves along the linear bearing as a result of pulling of the cord; and dial tensioners attached to each of the directional sheaves to individually increase or decrease tension of the cord on left or right sides of the pack and a dial tensioner attached to the central sheave to adjust the overall tension of the cord.

9. The apparatus of claim 8 further comprising flexible tubes on either side of the apparatus for guiding the cord into the fixed left and right re-directional sheaves, the free ends of the cord protruding from the flexible tubes.

10. The apparatus of claim 9 further comprising a tapered insert for each of the flexible tubes allowing the cord to travel smoothly in and out of the flexible tubes.

11. A fitness apparatus having a pack configured to be mounted to the back of an individual or to a fixed structure, comprising:

fixed left and right re-directional sheaves;

a movable central sheave;

a linear track bearing with coiled tension springs;

wherein the central sheave is anchored to and movable along the linear track bearing;

an elastic or stretchable cord having free ends on each side of the pack, each of the free ends having a ring or handle, the cord circling around the re-directional and central sheaves such that the linear bearing provides a tension of the cord via the springs as the central sheave moves along the linear bearing as a result of pulling of the cord;

wherein the coiled tension springs are attached to a tension adjustment to vary the tension on the cord.

12. The apparatus of claim 11 further comprising dial tensioners attached to each of the re-directional sheaves to individually increase or decrease tension of the cord on left or right sides of the pack.

13. The apparatus of claim 11 further comprising a dial tensioner attached to the central sheave to adjust the tension of the cord.

14. The apparatus of claim 11 wherein the linear track bearing comprises coiled tension springs that expand or contract with motion of the linear track bearing, wherein the linear track bearing provides the tension via the springs as the movable central sheave moves along the linear track bearing as a result of pulling of the cord.

15. The apparatus of claim 11 further comprising flexible tubes on either side of the apparatus for guiding the cord into the fixed left and right re-directional sheaves, the free ends of the cord protruding from the flexible tubes.

16. The apparatus of claim 15 further comprising a tapered insert for each of the flexible tubes allowing the cord to travel smoothly in and out of the flexible tubes.

* * * * *